US011006746B2

(12) United States Patent
Smith

(10) Patent No.: US 11,006,746 B2
(45) Date of Patent: May 18, 2021

(54) FIREARM DISPLAY AND STORAGE DEVICE AND METHOD

(71) Applicant: Warren Dean Smith, Erie, CO (US)

(72) Inventor: Warren Dean Smith, Erie, CO (US)

( * ) Notice: Subject to any disclaimer, the term of this patent is extended or adjusted under 35 U.S.C. 154(b) by 0 days.

(21) Appl. No.: 16/564,890

(22) Filed: Sep. 9, 2019

(65) Prior Publication Data

US 2021/0068538 A1 Mar. 11, 2021

(51) Int. Cl.
*A47B 81/00* (2006.01)
*G09F 23/06* (2006.01)

(52) U.S. Cl.
CPC ..... *A47B 81/005* (2013.01); *G09F 23/06* (2013.01)

(58) Field of Classification Search
CPC . B60R 7/14; F41A 23/00; F41A 23/18; F41A 13/18; F41C 9/08; A47B 81/005
USPC ..... 42/90, 70.11, 94; 224/912, 911, 913; 211/64
See application file for complete search history.

(56) References Cited

U.S. PATENT DOCUMENTS 1,687,129 A * 10/1928 Henninger ..... A47G 25/746 211/85.3
2,401,174 A * 5/1946 McAuley ..... A45F 5/021 224/243
2,765,107 A * 10/1956 Browning ..... F41C 33/0245 224/255
2,920,893 A * 1/1960 Walker ..... F42B 39/00 273/348
2,939,587 A * 6/1960 Kondziolka ..... A47B 81/005 211/64
3,468,427 A * 9/1969 Leslie ..... G09F 5/00 211/64
3,796,358 A * 3/1974 Grubb ..... F41A 17/02 224/255
4,015,358 A * 4/1977 Amos ..... F41A 9/83 42/87
4,027,417 A * 6/1977 Swatek ..... F42B 33/002 42/87
D253,737 S * 12/1979 Brink ..... D6/552
4,260,087 A * 4/1981 Leaver ..... A44B 11/005 224/163
4,364,499 A * 12/1982 McCue ..... B60R 7/14 211/64
4,384,424 A * 5/1983 Fowler ..... F42B 39/00 42/90
4,607,446 A * 8/1986 Scheuring ..... F41C 9/085 42/90
5,083,393 A * 1/1992 Smydas ..... F41A 9/85 42/89
5,092,072 A * 3/1992 Fritts ..... F41C 9/085 42/90

(Continued)

OTHER PUBLICATIONS

Itzafezookie, 1911 45 Stand Display, Mar. 30, 2017, https://www.thingiverse.com/thing:2216396, pp. 1-2.*

*Primary Examiner* — Kimberly T Wood
(74) *Attorney, Agent, or Firm* — David A. Costa

(57) ABSTRACT

A firearm display device comprises a body and a mounting rod projecting from the body. The mounting rod comprises a first diameter configured to accept a firearm muzzle bore of a predetermined firearm caliber. A caliber identifier corresponds to the predetermined caliber. A first hole in the body comprises a second diameter, wherein the second diameter comprises a diameter that accepts the caliber identifier.

4 Claims, 4 Drawing Sheets

(56) References Cited

U.S. PATENT DOCUMENTS 5,097,966 A * 3/1992 Miller ..... B25H 3/04 211/65
5,188,328 A * 2/1993 Thompson ..... F41A 23/18 211/64
5,499,724 A * 3/1996 Hickman ..... A47F 5/0876 211/59.1
5,503,276 A * 4/1996 Pierce ..... A47F 5/0807 211/59.1
5,544,441 A * 8/1996 Mahn ..... F41C 9/08 224/249
5,749,507 A * 5/1998 Wood ..... F41A 23/18 224/255
5,813,549 A * 9/1998 Sheehan ..... A47F 5/0807 211/59.1
5,813,550 A * 9/1998 Sheehan ..... A47F 5/0807 211/87.01
5,913,557 A * 6/1999 Jarock ..... F41C 33/001 294/15
6,523,704 B2 * 2/2003 Sanders ..... B25H 3/04 211/60.1
7,259,310 B2 * 8/2007 Wilfer ..... G10G 5/00 248/110
7,735,253 B2 * 6/2010 Giebel ..... A47B 81/00 42/70.11
8,533,876 B2 * 9/2013 Bonk ..... A47C 21/00 248/218.4
8,739,982 B2 * 6/2014 Werner ..... F41C 33/06 206/317
D725,939 S * 4/2015 Sheehan ..... D6/553
9,182,205 B2 * 11/2015 Sitz ..... F41A 23/18
9,261,328 B2 * 2/2016 Sitz ..... F41C 33/0245
9,574,847 B2 * 2/2017 Rossi ..... F41C 33/048
D847,488 S * 5/2019 McGrath ..... D3/201
10,408,566 B2 * 9/2019 Pagac ..... F41C 33/048
10,448,735 B2 * 10/2019 Carpenter ..... A47F 7/28
2012/0255979 A1 * 10/2012 Sitz ..... F41A 23/18 224/243
2012/0261368 A1 * 10/2012 Klein ..... A47F 7/0028 211/64
2015/0129440 A1 * 5/2015 Abascal ..... F41C 33/06 206/317
2016/0097610 A1 * 4/2016 Hancosky ..... B60R 7/14 42/94

* cited by examiner

FIREARM DISPLAY AND STORAGE DEVICE AND METHOD

FIELD OF THE INVENTION

The present invention generally concerns devices for the storage of firearms, and more specifically, relates to a display apparatus and related method for mounting firearms to a wall or similar object to retain and visually identify a firearm stored thereon.

BACKGROUND OF THE INVENTION

Firearm collections are often stored or displayed on shelving, cabinets, wall hooks, etc. This is especially true for firearms dealers, gun ranges, and individual firearm owners and collectors. Cabinets are often cumbersome for removing and placing firearms therein, and typically only shelves are available onto which firearms may be horizontally placed. In large collections or commercial displays, wall mounting may be far more convenient.

Locking racks often physically restrain firearms with cables or other locking mechanisms, which may prevent theft or unauthorized use, but are a hindrance in cases where firearms must be accessed quickly, such as in an armory, walk-in safe, or sales display.

Furthermore, typical storage solutions fail to identify firearms. This may be especially important in a situation where a firearm must be acquired from storage quickly. However, there are often a number of visually similar, yet different, firearms available, and a particular firearm or caliber must be chosen from one of many confusingly similar firearms. For example, a display having a variety of Glock® pistols may contribute to a time-consuming effort to choose an appropriate model, due to visual similarity between models. By way of example only, Glock® models G17, G22, G20, G21, G37, and G31 are all different calibers—i.e. 9×19 mm, 0.40, 10 mm Auto, 0.45 Auto, 0.45 G.A.P., and 0.357, respectively—yet are all full sized pistol frames that are virtually visually indistinguishable from each other without close inspection.

What is needed is a firearm display apparatus that provides instant access to a firearm and additionally provides fast visual identification. The embodiments provided herein fulfil these needs, and an advance in the art is realized.

SUMMARY OF THE INVENTION

A firearm display device is provided according to an embodiment. The firearm display device comprises a body and a mounting rod projecting from the body. The mounting rod comprises a first diameter configured to accept a firearm muzzle bore of a predetermined firearm caliber. A caliber identifier that corresponds to the predetermined caliber is provided. A first hole in the body comprises a second diameter, wherein the second diameter comprises a diameter that accepts the caliber identifier.

A method of displaying a firearm is provided according to an embodiment. The method comprises the steps of providing a body having a mounting rod projecting therefrom, wherein the mounting rod is configured to accept a firearm muzzle bore of a predetermined firearm caliber and defining a first hole in the body, wherein the first hole accepts a caliber identifier.

A firearm display device is provided according to an embodiment. The firearm display device comprises a body. A mounting rod projects from the body, and the mounting rod is configured to hold a portion of a firearm having a predetermined caliber. A caliber identifier that corresponds to the predetermined caliber is provided, and a first hole in the body comprises a diameter that accepts the caliber identifier.

ASPECTS OF THE INVENTION

According to an aspect, a firearm display device comprises a body and a mounting rod projecting from the body, wherein the mounting rod comprises a first diameter configured to accept a firearm muzzle bore of a predetermined firearm caliber. A caliber identifier corresponds to the predetermined caliber. A first hole in the body comprises a second diameter, wherein the second diameter comprises a diameter that accepts the caliber identifier.

Preferably, the caliber identifier is a bullet.

Preferably, the caliber identifier is at least a portion of a cartridge casing.

Preferably, the body comprises a second hole that passes through the body, and is configured to accept a mechanical fastener; and the first hole defines a countersink for the second hole.

Preferably, the mounting rod projects away from the body horizontally at an angle between approximately 30 degrees and 85 degrees.

Preferably, the first diameter and the second diameter are approximately the same. Preferably, the body comprises a display face comprising a textual caliber indicator corresponding to the predetermined firearm caliber.

According to an aspect, a method of displaying a firearm comprises providing a body having a mounting rod projecting therefrom, wherein the mounting rod is configured to accept a firearm muzzle bore of a predetermined firearm caliber. A first hole is defined in the body, wherein the first hole accepts a caliber identifier.

Preferably, the caliber identifier is a bullet.

Preferably, the caliber identifier is at least a portion of a cartridge casing.

Preferably, the method comprises the step of defining a second hole that passes through the body, wherein the second hole is configured to accept a mechanical fastener, and wherein the first hole defines a countersink for the second hole.

Preferably, the method comprises the step of angling the mounting rod horizontally away from the body at an angle between approximately 30 degrees and 85 degrees.

Preferably, a diameter of the first hole and a diameter of the mounting rod are approximately the same.

Preferably, the method comprises the step of providing a display face on the block, and visually identifying the predetermined firearm caliber on the display face.

According to an aspect, a firearm display device comprises a body and a mounting rod projecting from the body, wherein the mounting rod is configured to hold a portion of a firearm having a predetermined caliber. A caliber identifier corresponds to the predetermined caliber, and a first hole in the body comprising a diameter that accepts the caliber identifier.

Preferably, the caliber identifier is a bullet.

Preferably, the caliber identifier is at least a portion of a cartridge casing.

DETAILED DESCRIPTION OF THE INVENTION

FIGS. 1-5 and the following description depict specific examples to teach those skilled in the art how to make and use the best mode of embodiments of a firearm display device and related methods. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
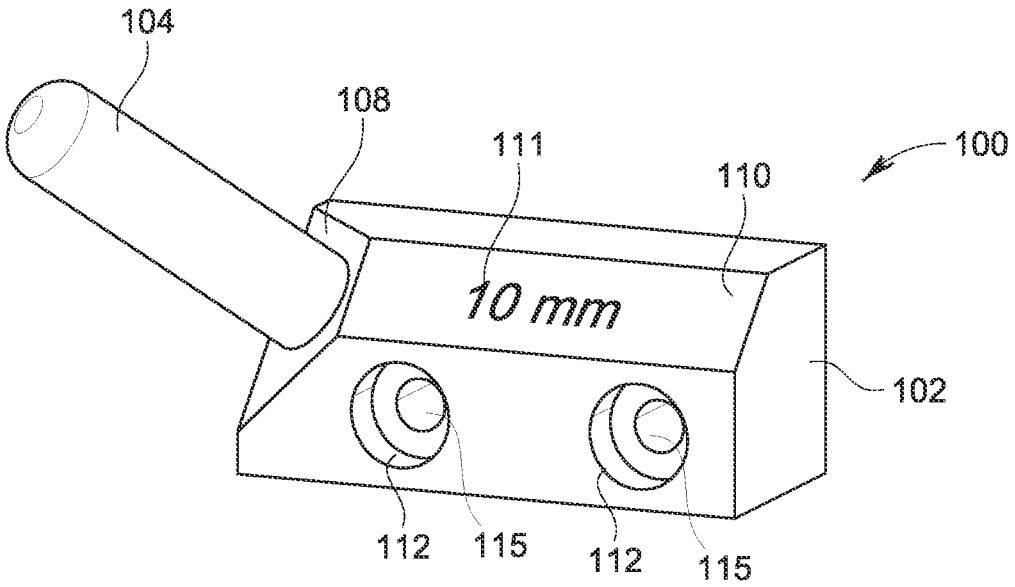
FIG. 1 illustrates an embodiment of a firearm display device 100.
Figure 2:
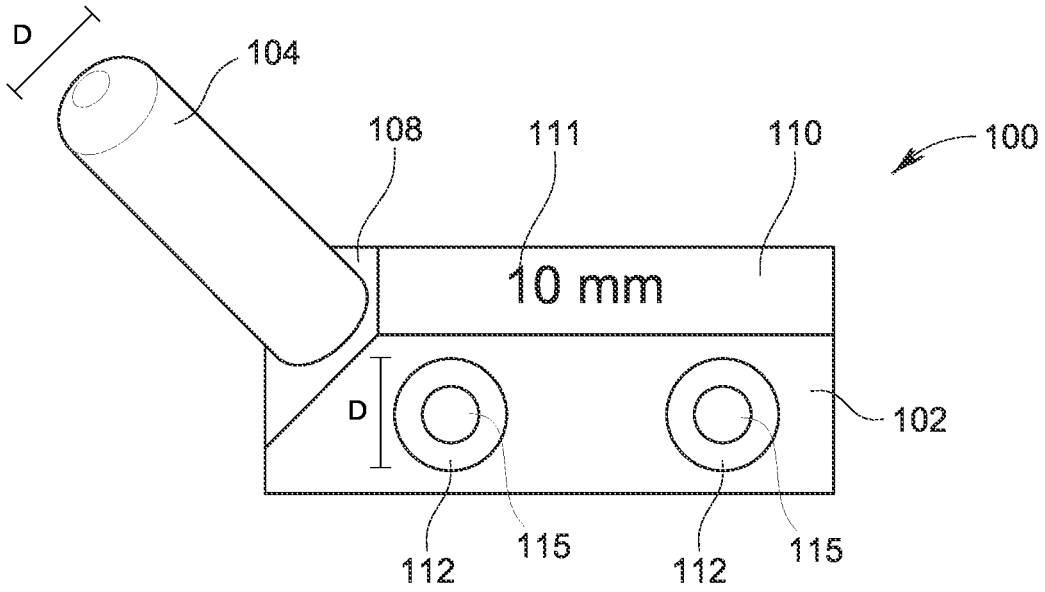
FIG. 2 illustrates another view of the embodiment of FIG. 1.
Figure 3:
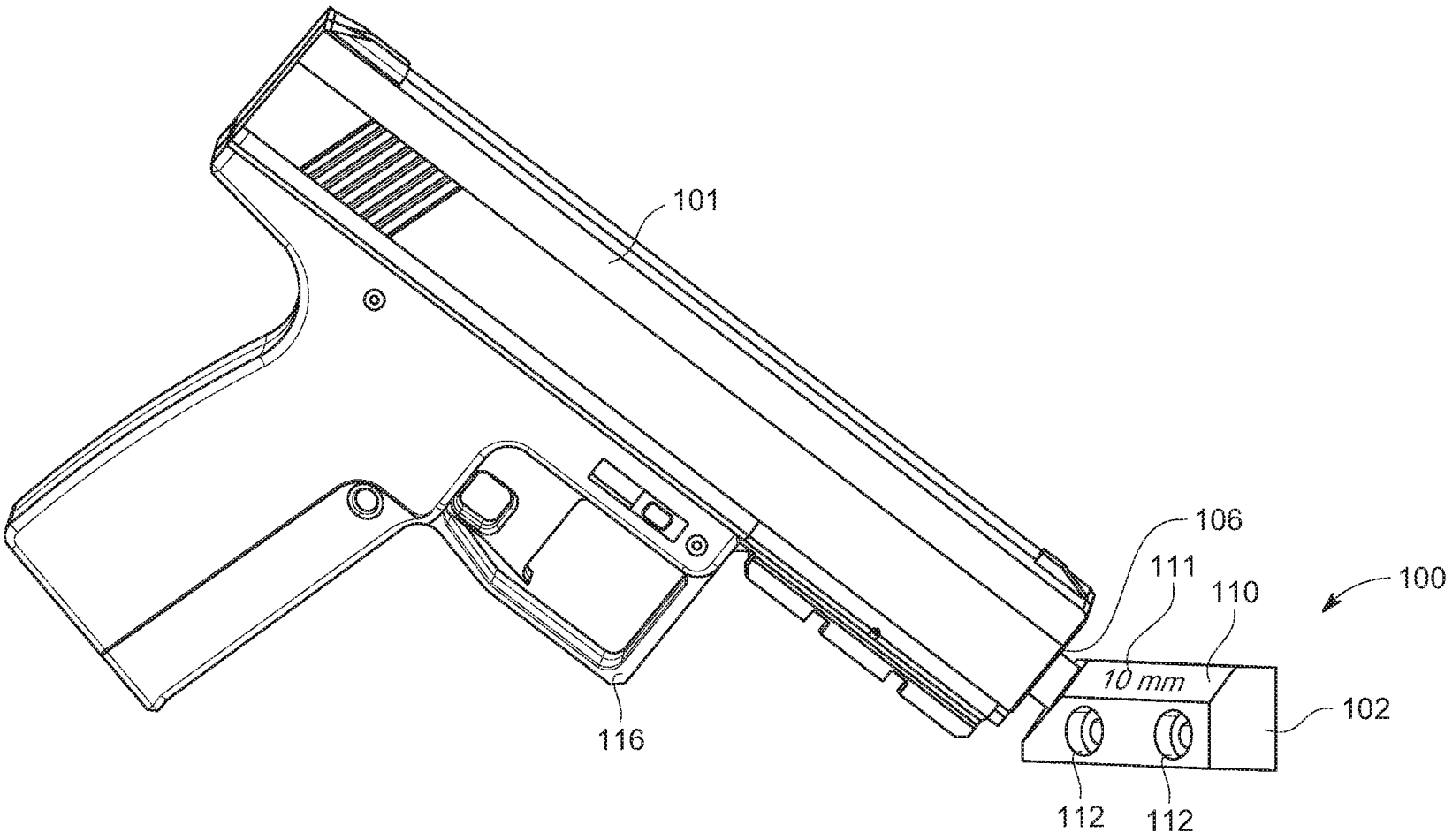
FIG. 3 illustrates an embodiment of a firearm display device 100 in use.

With reference to FIGS. 1-3 a firearm display device 100 is illustrated according to an embodiment. The firearm display device 100 is configured to hold a firearm 101 for storage and display, and also to provide means for instantly and unambiguously identifying the firearm 101 stored thereon. A body 102 is provided that allows the firearm display device 100 to be mounted to a surface. Such surfaces, for example and without limitation, could include walls or the inside of a cabinet or firearm safe, however any flat surface is contemplated.

Figure 5:
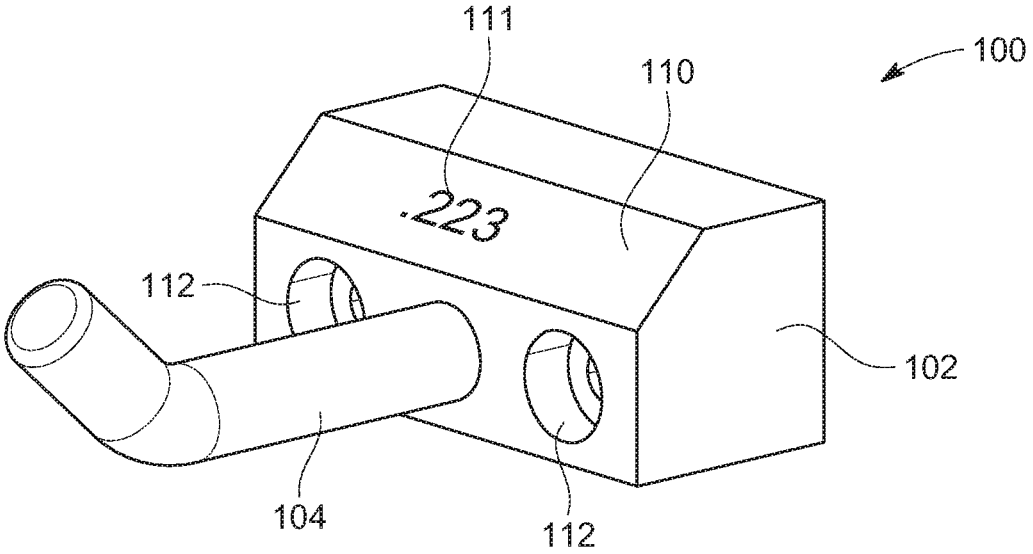
FIG. 5 illustrates an alternate embodiment of a firearm display device 100.

A mounting rod 104 projects from the body 102, and is configured to accept a firearm muzzle bore of a predetermined firearm caliber. For example, if the display device 100 is configured to accept a 10 mm Auto caliber firearm, the mounting rod 104 would comprise a mounting rod 104 with a diameter at a distal portion that is smaller than 10 millimeters, such that a muzzle 106 of the firearm 101 may slidingly engage the mounting rod 104. The mounting rod 104 is attached to the body 102 via at least one of a friction fit, mechanical fastening or fastener, adhesive, welding, and/or brazing. In an embodiment, the mounting rod 104 is a portion of the body 102. The mounting rod 104 extends from a face of the body 102. In an embodiment, the mounting rod 104 extends from a rod-mounting face 108. In an embodiment, the mounting rod 104 extends from a display face 110. In yet another embodiment, the mounting rod 104 extends from any other face of the body 102, such as that illustrated in FIG. 5. In an embodiment, the mounting rod horizontally projects away from the longitudinal axis of the body at an angle between approximately 30 degrees and 85 degrees, though other angles are contemplated, depending on the geometry of the firearm display device 100 and the firearm to be held thereon. FIG. 5, for example shows the mounting rod horizontally projects away from the longitudinal axis of the body at an angle of approximately 90 degrees.

The rod-mounting face 108 is a face of the body 102 that accepts the mounting rod 104, and is configured to angle the mounting rod 104 such that a firearm will rest securely thereon. For example, in an embodiment, the rod-mounting face 108 may be angled such that the mounting rod 104 extends in an upward direction such that the force of gravity keeps the firearm on the mounting rod 104. For example, in an embodiment, the rod-mounting face 108 may be angled such that the mounting rod 104 extends in a rightward or leftward direction (relative to the body 102 being mounted on a vertical surface) such that the firearm is directed diagonally away from the body. In such an embodiment, if a display face 110 is present, the display face 110 is thus easily visible, and not generally obfuscated by the firearm itself. This is illustrated in FIG. 3.

The display face 110 is a face of the body 102 that provides a textual identification 111 of the caliber of the firearm 101. The display face 110 may be etched, engraved, silk-screened, adhered, drawn or marked with an ink, paint, or other contrasting material, or otherwise configured to display a textual identification 111 comprised of text, numerals, and/or other characters that identify the caliber of the firearm 101 to be mounted on the firearm display device 100. For example without limitation, if the display device 100 is configured to accept a .357 caliber firearm, the textual identification 111 could be the characters "0.357" or "0.357 Magnum" or "0.357 S&W Magnum" or "9×33mmR", or any other equivalents, on the display face 110.

The mounting rod 104 is preferably made from a material that is softer than a firearm bore to prevent damaging the firearm 101. For example, without limitation, the mounting rod 104 may be constructed from brass, aluminum, or similar soft metals and alloys, or plastics, polymers, composites, or the like. Furthermore, the mounting rod 104 may be made from multiple materials such that an inner core region does not contact the firearm 101, and may thus be made out of relatively hard materials such as steel, while an outer region of the mounting rod 104 is covered in a material that is softer than a firearm bore. It is thus contemplated that soft rubbers, plastics, and similar soft materials or relatively soft alloys may be overmolded or otherwise installed onto the mounting rod 104. Such soft materials may, on their own, be unable to provide the desired structural integrity or longevity to reliably hold a firearm, but their properties may be advantageously utilized in conjunction with a stable and stronger core material.

Figure 4A:
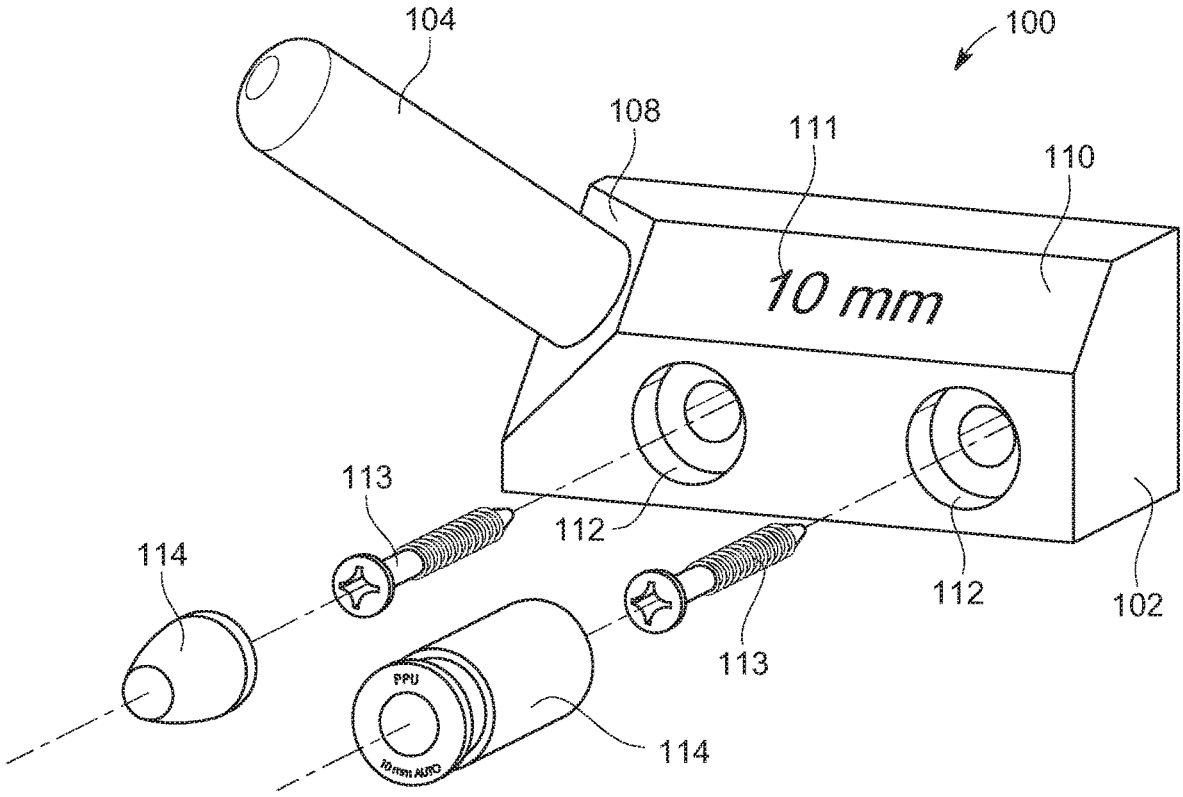
FIGS. 4A and 4B illustrate embodiments of the firearm display device 100 showing caliber identifiers.
Figure 4B:
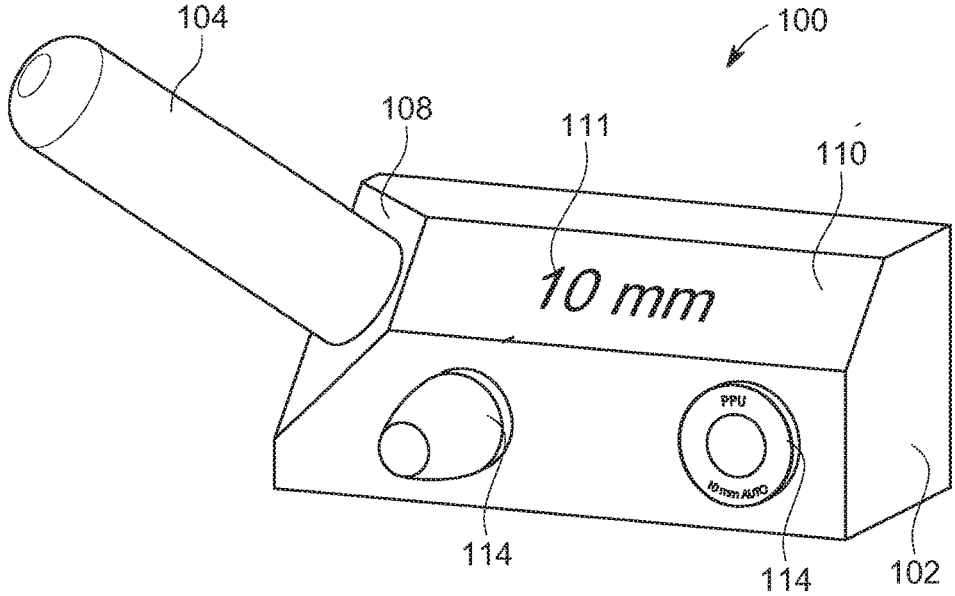

Turning to FIGS. 4A and 4B, in an embodiment, the body 102 may be mounted to a surface with a fastener 113 that passes through a hole 115 in the body 102. Proximate the hole 115 may be a countersink 112 defined by the body 102. The countersink 112 is configured to accept a caliber identifier 114. In an embodiment, there may be clearance in the countersink 112 for both a fastener and a caliber identifier 114, which in this case would hide the fastener when installed. The caliber identifier 114 is a bullet in an embodiment. The caliber identifier 114 is a cartridge casing or a modified cartridge casing in an embodiment. The caliber identifier 114 corresponds to the caliber of the firearm that the firearm display device 100 is configured to hold. Therefore, in some embodiments, the diameter of the countersink is approximately the same diameter as the mounting rod 104, which is approximately the diameter of the barrel muzzle of the firearm that the firearm display device 100 is configured to hold. This allows a bullet of the caliber of the firearm held by the display device to engage the countersink. It will be understood that the a few thousandths of an inch of tolerance will be necessary to allow a caliber identifier 114 to frictionally engage the countersink. In an embodiment where a cartridge casing is used as the caliber identifier 114, the diameter of the countersink is sized to accommodate an outer diameter of the cartridge casing. In FIG. 4A, the entire cartridge casing is illustrated. In FIG. 4B, a modified cartridge casing is illustrated, such that the cartridge casing is installed approximately flush with the body 102, or only slightly proud thereof.

Although mechanical fasteners 113 may, in an embodiment, be used to mount the body 102 to a surface as illustrated, in embodiments, the body may be welded, brazed, adhered, or otherwise mechanically attached to a mounting surface. Fasteners may be oriented such that they engage the body 102 from the direction of the body surface that contacts the mounting surface, such that the mechanical fastener engages threads or another feature of the body 102.

In FIG. 5, an embodiment of the firearm display device 100 is illustrated where the mounting rod 104 projects approximately orthogonally from the body 102. In such an embodiment, the mounting rod 104 may be curved as illustrated, or may be substantially straight. This embodiment may be configured to accommodate a firearm muzzle 106, or may be configured to hold a firearm 101 through its trigger guard 116. In an embodiment, two display devices 100 may be used in conjunction with each other to hold a long gun, such as a rifle, wherein one display device 100 is situated to hold one portion of the firearm (e.g. barrel or proximate the muzzle), and the other display device 100 is situated to hold another portion of the firearm (e.g. through the trigger guard 116).

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other devices and methods, and not just to the embodiments described above and shown in the accompanying figures. Accordingly, the scope of the invention should be determined from the following claims.

What is claimed is:

1. A firearm display device, comprising:

a body;

a mounting rod projecting from the body, wherein the mounting rod comprises a first diameter configured to accept a firearm muzzle bore of a predetermined firearm caliber;

a caliber identifier that corresponds to the predetermined caliber, wherein the caliber identifier comprises at least one of a bullet and a portion of a cartridge casing;

a first hole in the body comprising a second diameter, wherein the second diameter comprises a diameter that accepts the caliber identifier, wherein the first diameter and the second diameter are approximately the same;

wherein the body comprises a second hole that passes through the body, and is configured to accept a mechanical fastener;

wherein the first hole defines a countersink for the second hole; and wherein the body comprises a display face comprising a textual caliber indicator corresponding to the predetermined firearm caliber.

2. The firearm display device of claim 1, wherein the mounting rod projects away from the body horizontally at an angle between approximately 30 degrees and 85 degrees.

3. A method of displaying a firearm, comprising:

providing a body having a mounting rod projecting therefrom, wherein the mounting rod is configured to accept a firearm muzzle bore of a predetermined firearm caliber;

defining a first hole in the body, wherein the first hole accepts a caliber identifier comprising at least one of a bullet and a portion of a cartridge casing;

defining a second hole that passes through the body, wherein the second hole is configured to accept a mechanical fastener, wherein a diameter of the first hole and a diameter of the mounting rod are approximately the same;

wherein the first hole defines a countersink for the second hole providing a display face on the block comprising a textual caliber indicator corresponding to the predetermined firearm caliber.

4. The method of displaying a firearm of claim 3, further comprising the step of angling the mounting rod horizontally away from the body at an angle between approximately 30 degrees and 85 degrees.

* * * * *